US008632222B2

(12) United States Patent
Choi

(10) Patent No.: US 8,632,222 B2
(45) Date of Patent: Jan. 21, 2014

(54) LED LIGHTING EQUIPMENT WITH RADIATING STRUCTURE HAVING INCREASED SURFACE AREA AND HIGH VENTILATION EFFICIENCY

(75) Inventor: Gyu Geun Choi, Gangneung-si (KR)

(73) Assignee: Future Lighting Co., Ltd., Gangneung-si, Gangwon-do (KR)

( * ) Notice: Subject to any disclaimer, the term of this patent is extended or adjusted under 35 U.S.C. 154(b) by 143 days.

(21) Appl. No.: 13/375,222

(22) PCT Filed: Feb. 25, 2010

(86) PCT No.: PCT/KR2010/001169
§ 371 (c)(1),
(2), (4) Date: Nov. 29, 2011

(87) PCT Pub. No.: WO2010/137792
PCT Pub. Date: Dec. 2, 2010

(65) Prior Publication Data

US 2012/0075860 A1 Mar. 29, 2012

(30) Foreign Application Priority Data

May 29, 2009 (KR) ..... 10-2009-0047494

(51) Int. Cl.
*F21V 29/00* (2006.01)

(52) U.S. Cl.
USPC ..... 362/294; 362/373

(58) Field of Classification Search
None
See application file for complete search history.

(56) References Cited

U.S. PATENT DOCUMENTS

| | | | | |
|---|---|---|---|---|
| 2008/0007955 | A1 | 1/2008 | Li | |
| 2008/0089070 | A1 | 4/2008 | Wang | |
| 2010/0046197 | A1* | 2/2010 | Wang et al. | 362/84 |
| 2011/0169391 | A1* | 7/2011 | Mo et al. | 313/46 |
| 2013/0021794 | A1* | 1/2013 | Chinniah et al. | 362/235 |
| 2013/0088849 | A1* | 4/2013 | Lee et al. | 362/84 |

FOREIGN PATENT DOCUMENTS

KR 10-0899977 5/2009

OTHER PUBLICATIONS

International Search Report for PCT/KR2010/001169 Mailed on Oct. 8, 2010.

* cited by examiner

*Primary Examiner* — Ashok Patel
(74) *Attorney, Agent, or Firm* — Christopher Paul Mitchell

(57) ABSTRACT

Disclosed is LED lighting equipment formed with a radiating structure which can improve the heat radiation effect by having good ventilation and an increased surface area. According to the present invention, the LED lighting equipment comprises: a printed circuit board; a plurality of LEDs which are mounted on the front of the printed circuit board; a radiating structure which supports the printed circuit board, and radiates the heat generated from the plurality of LEDs; a power supply unit which is formed on the rear of the radiating structure, and supplies power to the plurality of LEDs through the printed circuit board; and a cover which protects the plurality of LEDs from the outside, wherein the radiating structure comprises a plate-shaped upper member, a lower member, and a plurality of intermediate members combined between the upper member and the lower member, and each of the plurality of intermediate members includes a body of which the inner part is hollow and a plurality of protrusions which are radially formed on the body.

7 Claims, 2 Drawing Sheets

LED LIGHTING EQUIPMENT WITH RADIATING STRUCTURE HAVING INCREASED SURFACE AREA AND HIGH VENTILATION EFFICIENCY

Related Applications

This application is a 371 application of International Application No. PCT/KR2010/001169, filed Feb. 25, 2010, which in turn claims priority from Korean Patent Application No. 10-2009-0047494, filed May 29, 2009, each of which is incorporated herein by reference in its entirety.

TECHNICAL FIELD

The present invention relates to a LED (Light Emitting Diode) lighting equipment, more particularly, a LED lighting equipment which can efficiently discharge a lot of heat generated from LEDs by means of a heat-radiating structure where a surface area is increased compared to general plate-type radiating plate and ventilation is made possible.

BACKGROUND ART

As general light bulbs used for lighting, there are fluorescent lamp, incandescent lamp or metal neon lamp for industrial application and the like, and most of these light bulbs have gas electric discharge tube structure that is used with gas being contained within its glass tube.

In the case of the above-mentioned general light bulbs, when gas leakage occurs due to damage of the glass tube by burning, the gas leakage may be a cause of air pollution, and if high luminescence is to be obtained, consumption of electrical power will be increased accordingly, and power lines suitable for increasing the electrical power have to be installed, which results in a problem that facility cost and maintenance cost are excessively spent.

Meanwhile, as a alternative for solving the problem of the above-mentioned light bulbs, a development of a lighting equipment has been recently proposed which uses LED (Light Emitting Diode) requiring a lower consumption of electrical power, wherein for the LED lighting equipment, LED with high luminescence and long life is employed, whereby the LED lighting equipment can have long life and intense light emission.

However, in the case of the LED lighting equipment, it has a feature that a lot of heat is generated due to the intense light emission of LEDs, so that most of the LED lighting equipments are provided with plate-type radiating plate.

However, conventional radiating plate included in the LED lighting equipment is mostly a simple plate type, wherein since surface area for heat radiation is restricted there is a problem that an efficiency of heat radiation is not so high. This fact is a cause of deterioration of the LED lighting equipment, and as a result the life of the LED lighting equipment is shortened.

To solve the problems, in recent the efficiency of heat radiation is increased by using the radiating plate with improved structure or changing material for the radiating plate.

However, for improvement of the structure of the radiating plate, in most cases, only protrusions or blades are formed on the radiating plate, and thus the surface area of the radiating equipment is not much increased, and external air does not well circulate via the radiating plate, so that there is a problem that enhancement of the efficiency of heat radiation is limited.

Furthermore, in the case of the change of the material for the radiating plate, Ag is mainly added of which heat conductivity is much higher than that of usual Al, and in this case there is a problem that production cost of the radiating plate is increased.

Therefore, a LED lighting equipment is needed which has a structure where the surface area for heat radiation is very large and good ventilation is ensured and therefore the efficiency of heat radiation can be increased, while using the radiating plate made of usual Al material, by solving the above-mentioned problems.

DISCLOSURE OF THE INVENTION

The object of the present invention is to provide a LED lighting equipment where a heat radiation structure is employed which can effectively discharge outwardly heat generated due to driving of the plurality of LEDs.

A LED lighting equipment according to an example of the present invention for achieving the object is characterized in that it comprises a printed circuit board; a plurality of LEDs which are mounted on the front surface of the printed circuit board; a radiating structure which supports the printed circuit board and radiates the heat generated from the plurality of LEDs; a power supply unit which supplies power to the plurality of LEDs through the printed circuit board; and a cover which protects the plurality of LEDs from the outside, wherein the radiating structure comprises a plate-shaped upper member, a lower member, and a plurality of intermediate members combined between the upper member and the lower member, and each of the plurality of intermediate members includes a body of which the inner part is hollow and a plurality of protrusions which are radially formed on the body.

In this connection, the body and the plurality of protrusions of the plurality of intermediate members are formed integrally with each other, and the upper member, the lower member and the plurality of intermediate members may be made of usual aluminum material. In this case, it is preferable that an insulation plate for electrically insulating the radiating structure and the printed circuit board is further formed on the back surface of the printed circuit board.

The LED lighting equipment according to the present invention may further comprise a side mount (160) combined to a side surface of the radiating structure, and thus the side mount allows the LED lighting equipment to be utilized for all lighting devices using the LED such as street light, guard light, flood light and fish-luring light. Furthermore, the back surface of the radiating structure (130) may be secured to a ceiling, whereby the LED lighting equipment can be utilized for application such as domestic LED lighting lamp.

The LED lighting equipment according to the present invention can maximally increase the surface area compared to general plate-type radiating plate by means of the upper member, the lower member and the plurality of intermediate member having an unique shape each constituting the radiating structure. Furthermore, there is an advantage that ventilation is made possible by the plurality of protrusion structures formed on the intermediate members.

Therefore, the LED lighting equipment according to the present invention has an effect that it as a whole can efficiently radiate a lot of heat generated at the time of driving the plurality of LEDs.

MODES FOR CARRYING OUT THE INVENTION

Figure 1:
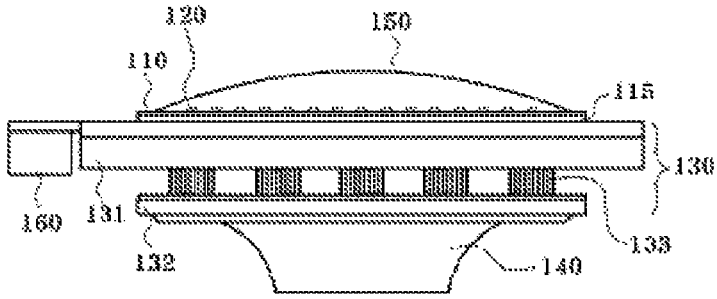
FIG. 1 is schematically illustrates a vertical section of LED lighting equipment according to an example of the present invention.

The advantages and features of the present invention and the method for achieving them will be apparent by referring to example described in detail hereinafter along with attached drawings. However, the present invention is not limited to the examples disclosed in the following, and may be embodied by various different forms. The example is provided only for the purpose of fully disclosing the present invention and fully indicating the scope of the present invention to persons having ordinary skills in the art related to the present invention, and the present invention is defined only by the claims. The same reference numerals throughout the specification designate the same components.

Hereinafter, with reference to the attached drawings, a LED lighting equipment according to preferred example of the present invention will be described in detail as follows which employs a heat-radiating structure where the surface area is increased and efficiency of ventilation is high.

FIG. 1 schematically illustrates a vertical section of LED lighting equipment according to an example of the present invention.

Referring to FIG. 1, the LED lighting equipment according to the present invention comprises a printed circuit board (110), a plurality of LEDs (120), a radiating structure (130), a power supply unit (140) and a cover (150). In this connection, the radiating structure (130) comprises an upper member (131), a lower member (132) and an intermediate members (133).

The printed circuit board (110) is formed with circuit pattern and provides positions where the plurality of LEDs (120) are mounted.

The plurality of LEDs (120) are mounted on the front surface of the printed circuit board (110). The plurality of LEDs (120) are a kind of p-n junction diode in which p-type and n-type semiconductor layers are joined, wherein electrical energy corresponding to band gap between conduction band and balance band is transformed into light energy to be emitted. Namely, if forward voltage above a predetermined voltage is applied through the power supply unit (140) to the p-n junction diodes constituting each of the plurality of LEDs (120), holes of the p-type semiconductor and electrons of the n-type semiconductor make a recombination while the holes are moved to the n-type semiconductor and the electrons are moved to the p-type semiconductor, whereby the light energy corresponding to the band gap is produced.

The radiating structure (130) supports the printed circuit board (110) on back surface thereof and outwardly radiates the heat generated from the plurality of LEDs (120). The radiating structure (130) in the present invention comprises an upper member (131), a lower member (132) and intermediate members (133).

The upper member (131) disposed on the side of the printed circuit board (110) and the lower member (132) disposed on the side of the power supply unit (140) have a plate-like shape, and in this connection, a single plate type or a type where a plurality of plates are laminated may be employed.

Each of the plurality of intermediate members (133) are combined with the upper member (131) and the lower member (132).

Figure 2:
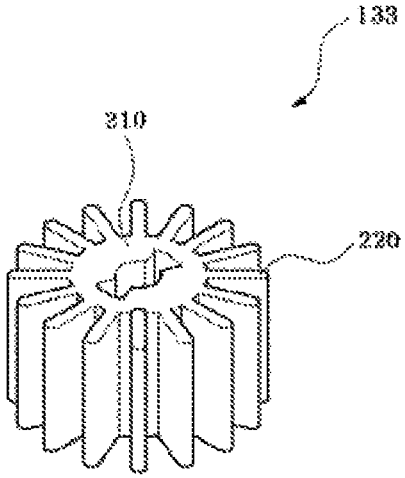
FIG. 2 illustrates an example of the intermediate member used in the present invention.

FIG. 2 illustrates an example of the intermediate member used in the present invention.

Referring to FIG. 2, the intermediate member (133) comprises a body (210) and a plurality of protrusions (220).

The body (210) is internally hollow, and the plurality of protrusions (220) are laterally and radially protruded from the body (210). In this connection, the body (210) and the plurality of protrusions (220) forming the intermediate member (133) may have such a combination structure that each of the plurality of protrusions (220) is radially combined to the body (210) or that the plurality of protrusions (220) and the body (210) are formed integrally with each other.

The upper member (131), the lower member (132) and the plurality of intermediate members (133) each constituting the radiating structure (130) may be made of aluminum material used as material for general radiating plate (heat sink).

Each intermediate member (133) may be combined to the upper member (131) and the lower member (132) by adhesion. Furthermore, formed on the upper member (131) and the lower member (132) may be protrusion structures corresponding to the hollow structure within the body (210) of the intermediate member, and the intermediate member (133) may be combined to the upper member (131) and the lower member (132) in a fitting manner by using the hollow structure within the body (210) of the intermediate member.

The structure of each of the plurality of intermediate members (133) illustrated in FIG. 2 has an effect that surface area of the whole radiating structure (130) is increased due to the plurality of protrusions (220) combined with the body (210). In addition, since the intermediate members (133) are plural in number, lateral ventilation is made possible.

Though not illustrated in the drawings, mounted on one side surface of the intermediate member (133) may be a fan that is driven by connection to a power supply unit separate from the power supply unit for the plurality of LEDs. By driving the fan mounted, when the plurality of LEDs (120) are driven, hot air present between the plurality of the intermediate members (133) is discharged outward or outside air is introduced between the plurality of intermediate members (133), whereby a ventilation effect can be obtained.

The power supply unit (140) may be separately installed in the outside and mounted on side surface or back surface of the radiating structure (130), and may be mounted on back surface of the radiating structure (130) as illustrated in the drawings. Such a power supply unit (140) is electrically connected to an external power source to thereby supply a power necessary for driving of the plurality of LEDs (120) through the printed circuit board (110). The power supply unit (140) receives normal alternating current such as AC 110V, AC 220V etc. supplied from the outside and transforms the alternating current into direct current through rectification process and the like to supply the direct current to the plurality of LEDs (120) through the printed circuit board (110), whereby each of the plurality of LEDs (120) can be driven by the direct current.

The cover (150) protects the plurality of LEDs (120) from the outside. This cover (150) may be secured to the printed circuit board (110) and also secured to the upper member (131) of the radiating structure (130).

The cover (150) may be a transparent cover made of transparent material such as transparent glass or transparent acryl or a translucent cover which is produced by applying white or milk-white pigment and the like to the transparent material or by previously incorporating white or milk-white pigment and the like at the time of production of glass and acryl for the cover.

In the case of the transparent cover, light with high luminance can be illuminated in a straight direction, but the light source is not hidden and the light is difficult to be diffused in a direction other than the straight direction. Therefore, the translucent cover is more preferable in which an effect of the light being hidden can be obtained and the light can be also illuminated in a direction other than the straight direction by diffusion. Furthermore, both of the transparent cover and the translucent cover may be formed on inner or outer surface thereof with embossing pattern for structurally ensuring the light diffusability.

Further formed on the back surface of the printed circuit board (110) may be an insulation plate (115) for electrically insulating the radiating structure (130) and the printed circuit board (110).

The LED lighting equipment according to the present invention may further comprise a side mount (160) combined to a side surface of the radiating structure (130). In this case, the LED lighting equipment according to the present invention has a downward illumination direction and mechanically connected on its side surface, so that it may be utilized for street light. In this connection, the side mount (160) of the LED lighting equipment according to the present invention is combined to a member such as a side bar installed on a post of the street light. Furthermore, the back surface of the radiating structure (130) may be secured to a ceiling, and in this case the LED lighting equipment according to the present invention may replace domestic box-type fluorescent lamp, and moreover may be utilized as a lighting equipment installed indoors. The back surface of the radiating structure (130) can be secured to the ceiling by combining the upper member (131) or the lower member (132) of the radiating structure (130) to a combining member, which is fixedly installed on or inside the ceiling, by screwing.

Namely, the LED lighting equipment according to the present invention may be utilized for all of indoor or outdoor lighting devices using the LED such as street light, guard light, flood light, fish-luring light and domestic lighting lamp.

Meanwhile, the upper member (131), the lower member (132) and the plurality of intermediate members (133) each constituting the radiating structure (130) are exposed to the outside. Therefore, corrosion may be occurred due to humidity etc. In order to maximally delay such corrosion, each of the members (131, 132, 133) constituting the radiating structure (130) may be coated with corrosion-resistant coating liquid such as commercial 5380DP produced by Korea Coating Corp. and in this case titanium that is more resistant to the corrosion may be further contained in the corrosion-resistant coating liquid.

Figure 3:
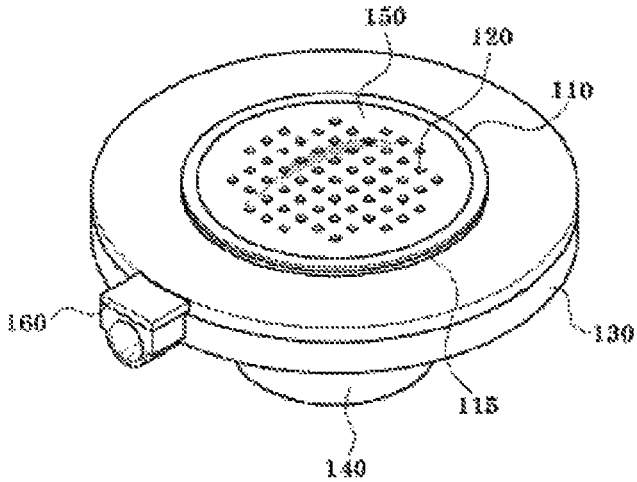
FIGS. 3 and 4 show a front side and a back side of the LED lighting equipment according to the present invention, respectively.
Figure 4:
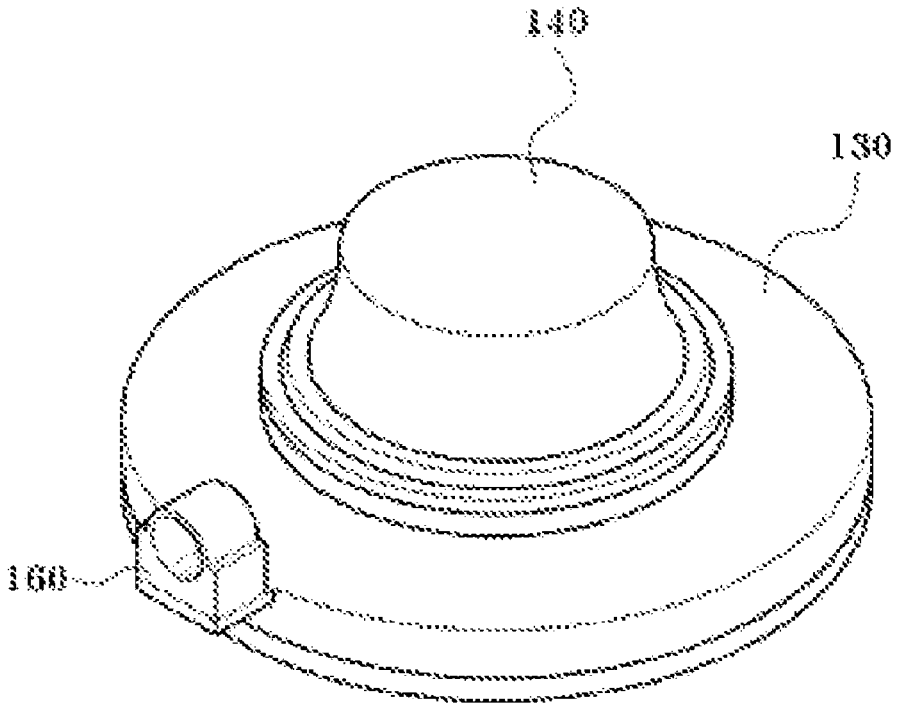

FIGS. 3 and 4 show a front side and a back side of the LED lighting equipment according to the present invention, respectively.

Referring to FIG. 3, in the front side of the LED lighting equipment, the insulation plate (115) and the printed circuit board (110) are arranged on the radiating structure (130), and the plurality of LEDs (120) are mounted on the front surface of the printed circuit board (110).

Referring to FIG. 4, in the back side of the LED lighting equipment, the power supply unit (140) is arranged on the back surface of the radiating structure (130).

Meanwhile, the side mount (160) is formed as shown in FIGS. 3 and 4, and though not shown in these figures, the plurality of intermediate members (133 in FIGS. 1 and 2) comprising the body and the plurality of the protrusions are incorporated in the radiating structure (130).

As described above, the LED lighting equipment according to the present invention can maximally increase surface area for heat radiation compared to general plate-type radiating plate by means of the upper member, the lower member and the plurality of intermediate member having an unique shape as illustrated in FIG. 2 each constituting the radiating structure. Furthermore, there is an advantage that ventilation is made possible by means of the plurality of protrusion structures radially formed on the intermediate member.

Therefore, the LED lighting equipment according to the present invention has an effect that it as a whole can efficiently radiate a lot of heat generated at the time of driving the plurality of LEDs.

As above, though the present invention has been described with one example of it, various alterations or modifications may be made by the persons having ordinary skills in the art. Such alterations and modifications can be said to belong to the present invention as long as they do not depart from the scope of the present invention. Therefore, the scope of claims of the present invention should be defined by the following claims.

What is claimed:

1. A LED lighting equipment comprising:

a printed circuit board;

a plurality of LEDs which are mounted on the front surface of the printed circuit board;

a radiating structure which supports the printed circuit board and radiates the heat generated from the plurality of LEDs;

a power supply unit which supplies power to the plurality of LEDs through the printed circuit board; and a cover which protects the plurality of LEDs from the outside, wherein the radiating structure comprises a plate-shaped upper member, a lower member, and a plurality of intermediate members combined between the upper member and the lower member, and each of the plurality of intermediate members includes a body of which the inner part is hollow and a plurality of protrusions which are radially formed on the body, and the upper member, the lower member and the plurality of intermediate members are made of aluminum material, and an insulation plate for electrically insulating the radiating structure and the printed circuit board is formed on the back surface of the printed circuit board.

2. The LED lighting equipment according to claim 1, wherein the body and the plurality of protrusions of the plurality of intermediate members are formed integrally with each other.

3. The LED lighting equipment according to claim 1, wherein the back surface of the radiating structure is secured to a ceiling.

4. The LED lighting equipment according to claim 1, wherein the power supply unit transforms alternating current into direct current to supply the direct current to the plurality of LEDs.

5. The LED lighting equipment according to claim 1, wherein the power supply unit is arranged outside or mounted on the back surface of the radiating structure.

6. The LED lighting equipment according to claim 1, wherein the lighting equipment is an indoor or outdoor lighting equipment.

7. A LED lighting equipment comprising:

a printed circuit board;

a plurality of LEDs which are mounted on the front surface of the printed circuit board;

a radiating structure which supports the printed circuit board and radiates the heat generated from the plurality of LEDs;

a power supply unit which supplies power to the plurality of LEDs through the printed circuit board;

a cover which protects the plurality of LEDs from the outside; and a side mount combined to a side surface of the radiating structure, wherein the radiating structure comprises a plate-shaped upper member, a lower member, and a plurality of intermediate members combined between the upper member and the lower member, and each of the plurality of intermediate members includes a body of which the inner part is hollow and a plurality of protrusions which are radially formed on the body.

* * * * *